US010845731B2

(12) United States Patent
Itabashi

(10) Patent No.: US 10,845,731 B2
(45) Date of Patent: Nov. 24, 2020

(54) DEVELOPER CARTRIDGE MOUNTABLE TO A DRUM CARTRIDGE

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/750,558

(22) Filed: Jan. 23, 2020

(65) Prior Publication Data

US 2020/0310288 A1 Oct. 1, 2020

(30) Foreign Application Priority Data

Mar. 28, 2019 (JP) ..... 2019-064193

(51) Int. Cl.
*G03G 15/08* (2006.01)
*G03G 21/18* (2006.01)
*G03G 21/16* (2006.01)

(52) U.S. Cl.
CPC ..... *G03G 15/0865* (2013.01); *G03G 21/1647* (2013.01); *G03G 21/1676* (2013.01); *G03G 21/1821* (2013.01)

(58) Field of Classification Search
CPC ..... G03G 21/1647; G03G 21/1652; G03G 21/1676; G03G 21/1817; G03G 21/1821; G03G 21/1867; G03G 21/1871
USPC ..... 399/90, 113, 119
See application file for complete search history.

(56) References Cited

U.S. PATENT DOCUMENTS 8,644,730 B2 * 2/2014 Takagi ..... G03G 21/1821 399/113
9,927,767 B2 * 3/2018 Itabashi et al. .... G03G 21/1867

FOREIGN PATENT DOCUMENTS

JP 2018-5177 A 1/2018

* cited by examiner

*Primary Examiner* — William J Royer
(74) *Attorney, Agent, or Firm* — Merchant & Gould P.C.

(57) ABSTRACT

A developer cartridge includes a developing roller, a housing, an electrode, a gear, and a hook. The developing roller is rotatable about an axis extending in a first direction. The housing extends in the first direction and is configured to store toner therein. The electrode is positioned at an outer surface of the housing in the first direction and extends in the first direction. The gear is rotatable about the electrode. The hook is positioned opposite to the developing roller relative to the gear in a second direction and is movable between a first position and a second position.

11 Claims, 9 Drawing Sheets

DEVELOPER CARTRIDGE MOUNTABLE TO A DRUM CARTRIDGE

CROSS-REFERENCE TO RELATED APPLICATION

This application claims priority from Japanese Patent Application No. 2019-064193 filed on Mar. 28, 2019, the content of which is incorporated herein by reference in its entirety.

TECHNICAL FIELD

Aspects of the disclosure relate to a developer cartridge.

BACKGROUND

A known developer cartridge includes a developing roller, a housing, an electrode, and a gear. The developing roller is rotatable about an axis extending in a first direction. The housing extends in the first direction and is configured to store toner therein. The electrode is positioned at an outer surface of the housing in the first direction and the electrode extends in the first direction. The gear is rotatable about the electrode. The developer cartridge is mountable to a drum cartridge.

SUMMARY

There is a need for providing to the known developer cartridge a lock unit configured to lock the developer cartridge mounted on a drum cartridge to the drum cartridge and prevents removal of the developer cartridge from the drum cartridge.

It is conceivable to provide a lock unit to the drum cartridge. However, downsizing the drum cartridge may make it difficult to secure a space, at the drum cartridge, for providing a lock unit.

Aspects of the disclosure provide a developer cartridge that allows for providing a lock unit thereto even when there is a difficulty to provide a lock unit to a drum cartridge.

According to one or more aspects of the disclosure, a developer cartridge includes a developing roller, a housing, an electrode, a gear, and a hook. The developing roller is rotatable about an axis extending in a first direction. The housing extends in the first direction and is configured to store toner therein. The electrode is positioned at an outer surface of the housing in the first direction and extends in the first direction. The gear is rotatable about the electrode. The hook is positioned opposite to the developing roller relative to the gear in a second direction and is movable between a first position and a second position.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

1. Overview of Developer Cartridge 1

Figure 1:
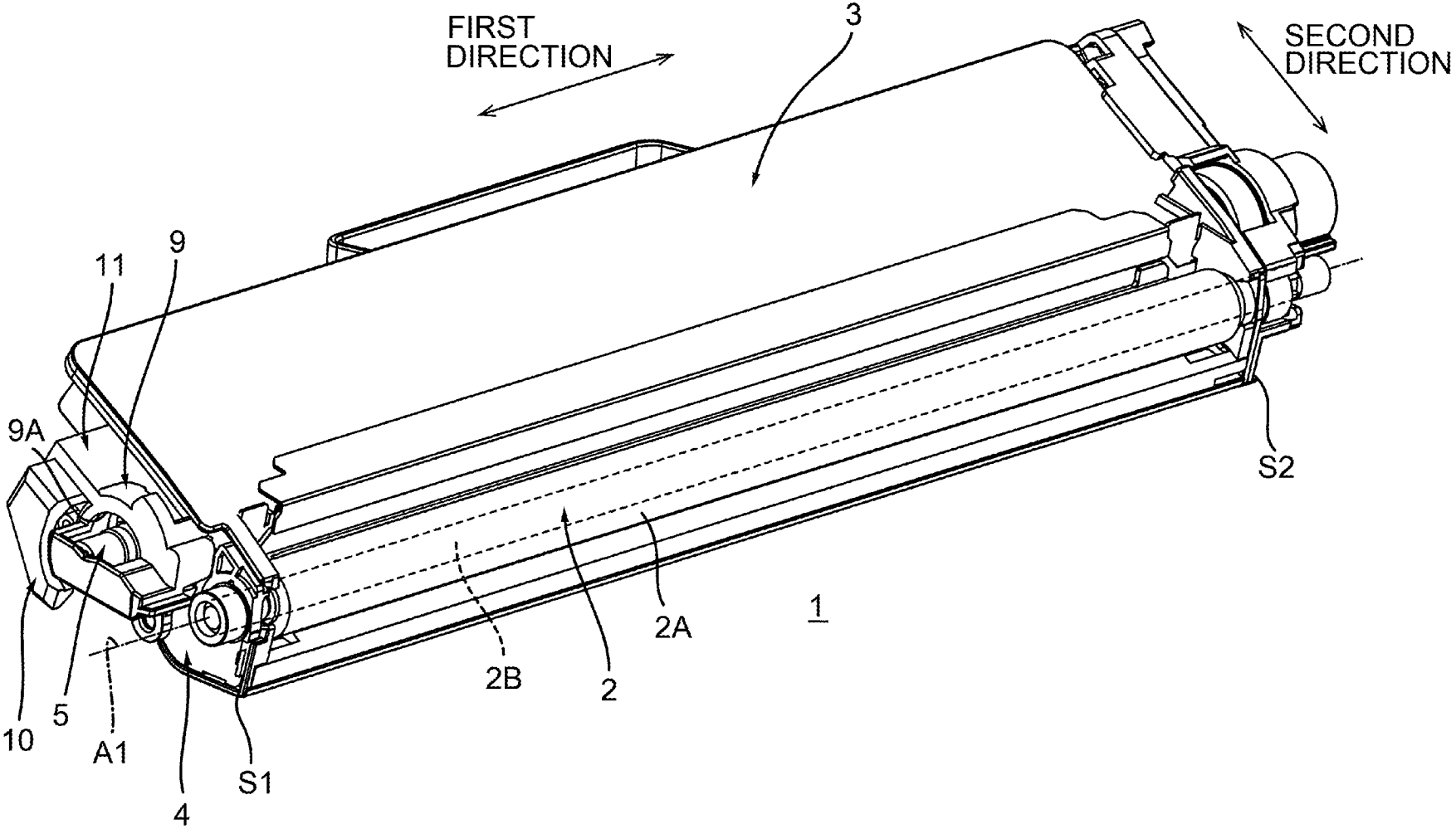
FIG. 1 is a perspective view of a developer cartridge.

An overview of a developer cartridge 1 according to an illustrative embodiment of the disclosure will be described with reference to FIGS. 1 and 2.

The developer cartridge 1 is configured to store toner therein. The developer cartridge 1 includes a developing roller 2, a housing 3, a bearing 4, an electrode 5, an agitator gear 6 (refer to FIG. 2), a gear 7 (refer to FIG. 2), a protrusion 8 (refer to FIG. 2), and a gear cover 9.

1.1 Developing Roller 2

As shown in FIG. 1, the developing roller 2 is rotatable about an axis A1 extending in a first direction. The developing roller 2 includes a developing roller body 2A and a developing roller shaft 2B.

The developing roller body 2A extends in the first direction. The developing roller body 2A is made of a conductive rubber. The developing roller body 2A is cylindrical. A portion of the developing roller body 2A is exposed from the housing 3.

The developing roller shaft 2B extends along the axis A1. The developing roller shaft 2B is cylindrical. The developing roller shaft 2B is made of metal. The developing roller shaft 2B is positioned inside the developing roller body 2A in a radial direction of the developing roller body 2A. The developing roller shaft 2B penetrates through the developing roller body 2A in the first direction. Alternatively, the developing roller shaft 2B may not penetrate the developing roller body 2A in the first direction. The developing roller shaft 2B may be attached to each of opposite ends of the developing roller body 2A. The developing roller 2 is rotatable about the developing roller shaft 2B.

1.2 Housing 3

The housing 3 is configured to store toner therein. The housing 3 extends in the first direction. The housing 3 includes an outer surface S1 positioned on one side thereof in the first direction, and an outer surface S2 positioned on the other side thereof in the first direction.

1.3 Bearing 4

Figure 2:
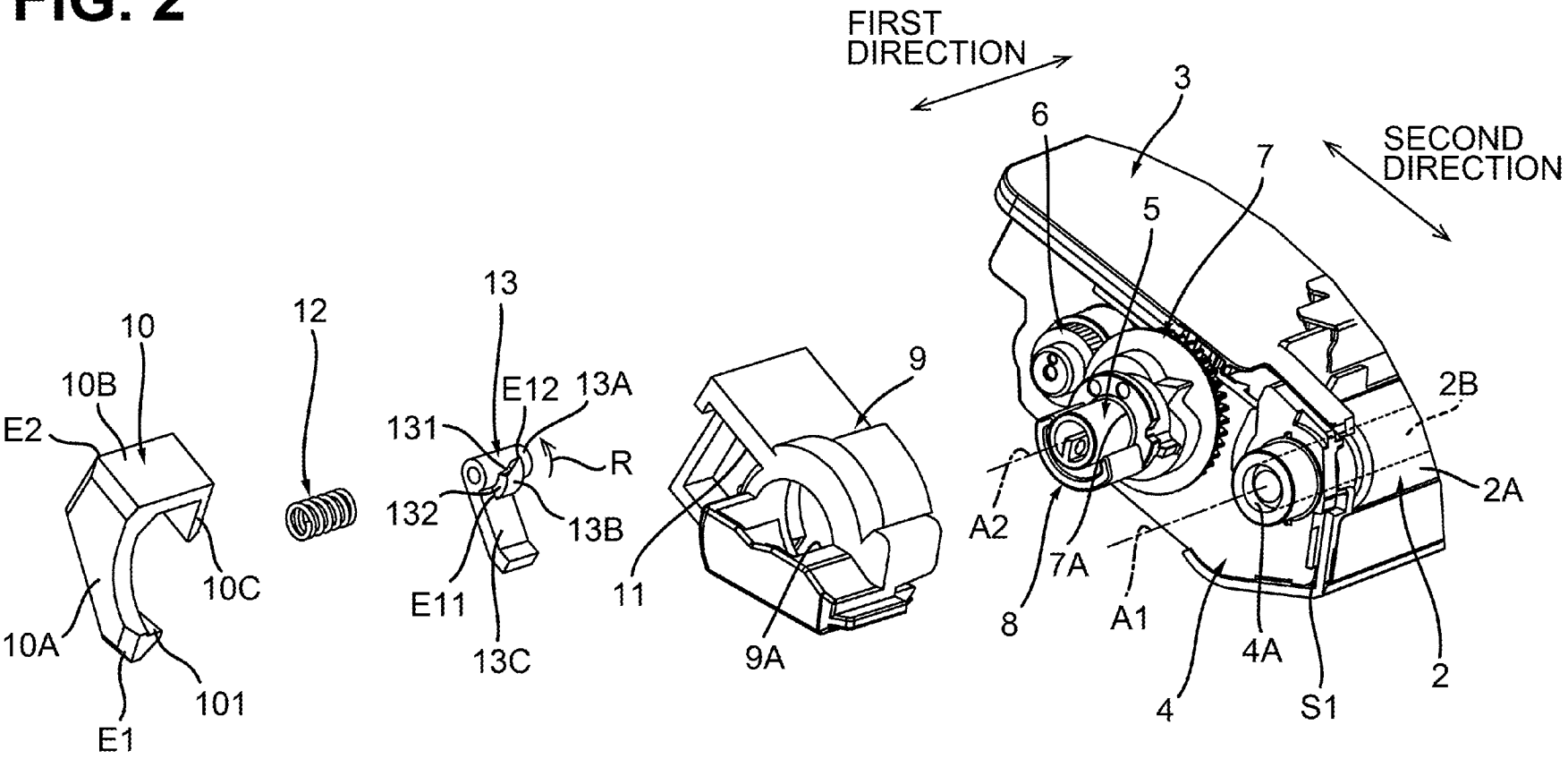
FIG. 2 is an exploded perspective view of the developer cartridge of FIG. 1.

As shown in FIG. 2, the bearing 4 is positioned at the outer surface S1. The bearing 4 has a through-hole 4A. The developing roller shaft 2B is inserted in the through-hole 4A. Thus, the bearing 4 bears the developing roller shaft 2B. The bearing 4 is made of a conductive resin. In a state in which the bearing 4 bears the developing roller shaft 2B, the bearing 4 and the developing roller shaft 2B are electrically connected.

1.4 Electrode 5

The electrode 5 is positioned at the outer surface S1 of the housing 3 in the first direction. The electrode 5 is spaced from the developing roller 2 in a second direction. The second direction crosses the first direction. Preferably, the second direction is orthogonal to the first direction. The electrode 5 is electrically connected to the developing roller 2. Specifically, the electrode 5 is made of a conductive resin and extends from the bearing 4. Thus, electricity received by the electrode 5 is transmitted, via the bearing 4, to the developing roller 2. The electrode 5 extends in the first direction. Specifically, the electrode 5 extends along an axis A2 extending in the first direction. The electrode 5 is cylindrical.

1.5 Agitator Gear 6

The agitator gear 6 is positioned at the outer surface S1. The agitator gear 6 is attached to an agitator (not shown). The agitator is provided in the housing 3. The agitator rotates upon receipt of power from an image forming device via a coupling and a gear train which are not shown but positioned at the outer surface S2 (refer to FIG. 1). The agitator rotates to agitate toner in the housing 3. The agitator gear 6 is rotatable with the agitator.

1.6 Gear 7

The gear 7 is positioned at the outer surface S1 of the housing 3. The gear 7 is rotatable about the electrode 5. Specifically, the gear 7 has a through-hole 7A. The electrode 5 is inserted in the through-hole 7A. This allows the gear 7 to rotate about the electrode 5. The gear 7 meshes with the agitator gear 6. The gear 7 is a chipped teeth gear including a portion with gear teeth and a portion without gear teeth. In a state in which the developer cartridge 1 is mounted on the image forming device, the gear 7 rotates while the gear teeth are in mesh with the agitator gear 6. The gear 7 stops rotating when the gear teeth are released from the agitator gear 6.

1.7 Protrusion 8

The protrusion 8 is rotatable with the gear 7. The protrusion 8 rotates with the gear 7, thereby rotating around the electrode 5. The protrusion 8 extends from the gear 7. The protrusion 8 extends in the first direction. The protrusion 8 also extends in a rotation direction of the gear 7. Specifically, a single protrusion 8 is provided. Alternatively, plural protrusions may be provided. In this case, the plural protrusions may be arranged at intervals in the rotation direction of the gear 7.

1.8 Gear Cover 9

As shown in FIG. 1, the gear cover 9 is positioned at the outer surface S1 of the housing 3. The gear cover 9 is attached to the outer surface S1 of the housing 3. The gear cover 9 covers at least a portion of the gear 7 (refer to FIG. 2). The gear cover 9 has an opening 9A. The electrode 5 is positioned in the opening 9A. While the protrusion 8 rotates, with the gear 7, around the electrode 5, the protrusion 8 moves out of the gear cover 9 to be exposed through the opening 9A and then moves into the gear cover 9 away from the opening 9A.

2. Details of Developer Cartridge 1

Referring now to FIGS. 1 through 6B, the developer cartridge 1 will be described in detail.

As shown in FIGS. 1 and 2, the developer cartridge 1 further includes a hook 10, a guide 11, a tension spring 12 (refer to FIG. 2), and a cam 13 (refer to FIG. 2).

Figure 3:
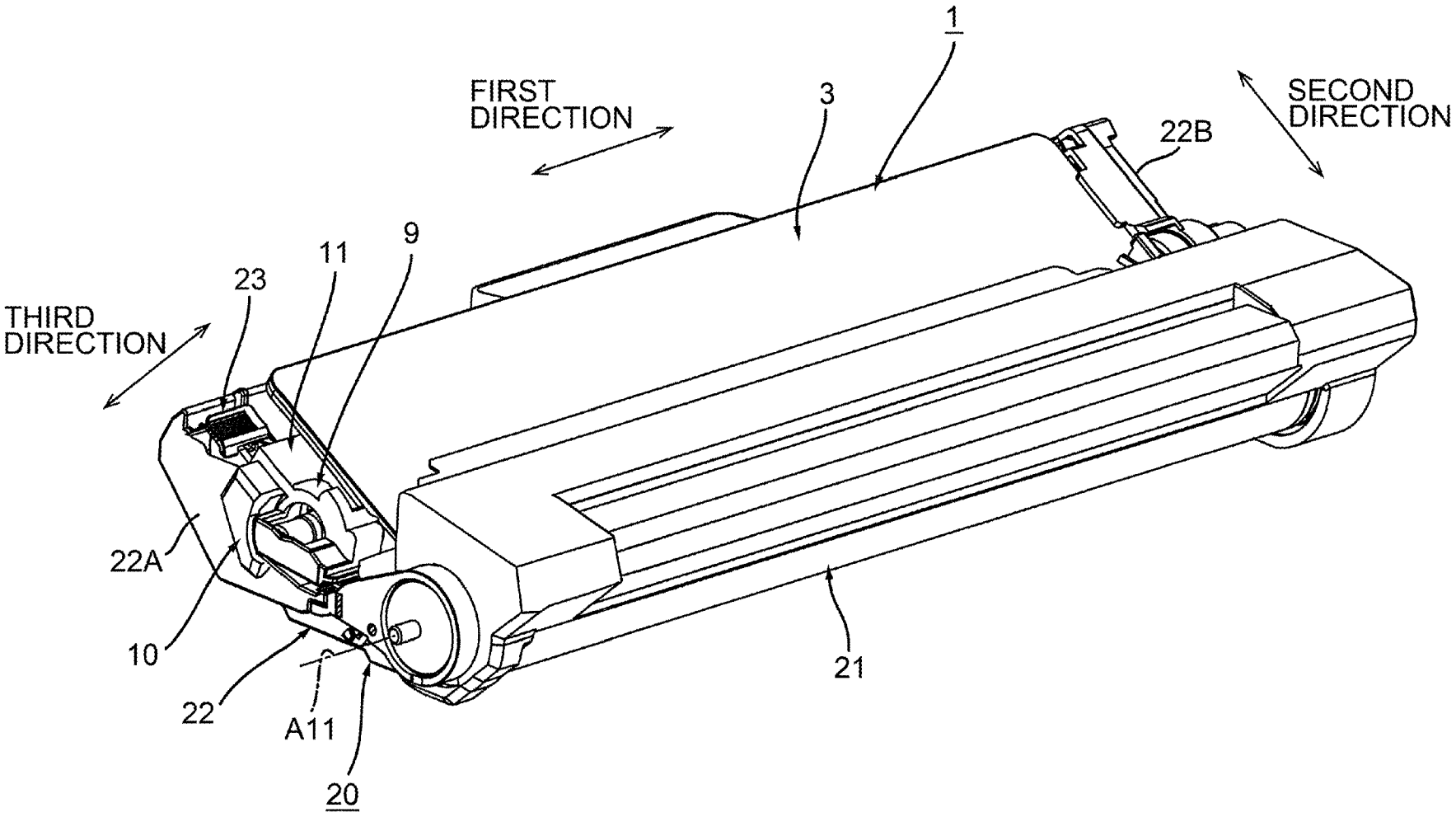
FIG. 3 is a perspective view of a drum cartridge on which the developer cartridge is mounted.

As shown in FIG. 3, the developer cartridge 1 is mountable to a drum cartridge 20.

2.1 Hook 10

As shown in FIG. 1, in this illustrative embodiment, the hook 10 is attached to the gear cover 9. The hook 10 is positioned, via the gear cover 9, at the outer surface S1 of the housing 3. Alternatively, the hook 10 may be attached to the housing 3. The hook 10 is positioned opposite to the developing roller 2 relative to the electrode 5 in the second direction. The hook 10 is positioned opposite to the developing roller 2 relative to the gear 7 (refer to FIG. 2) in the second direction.

Figure 4A:
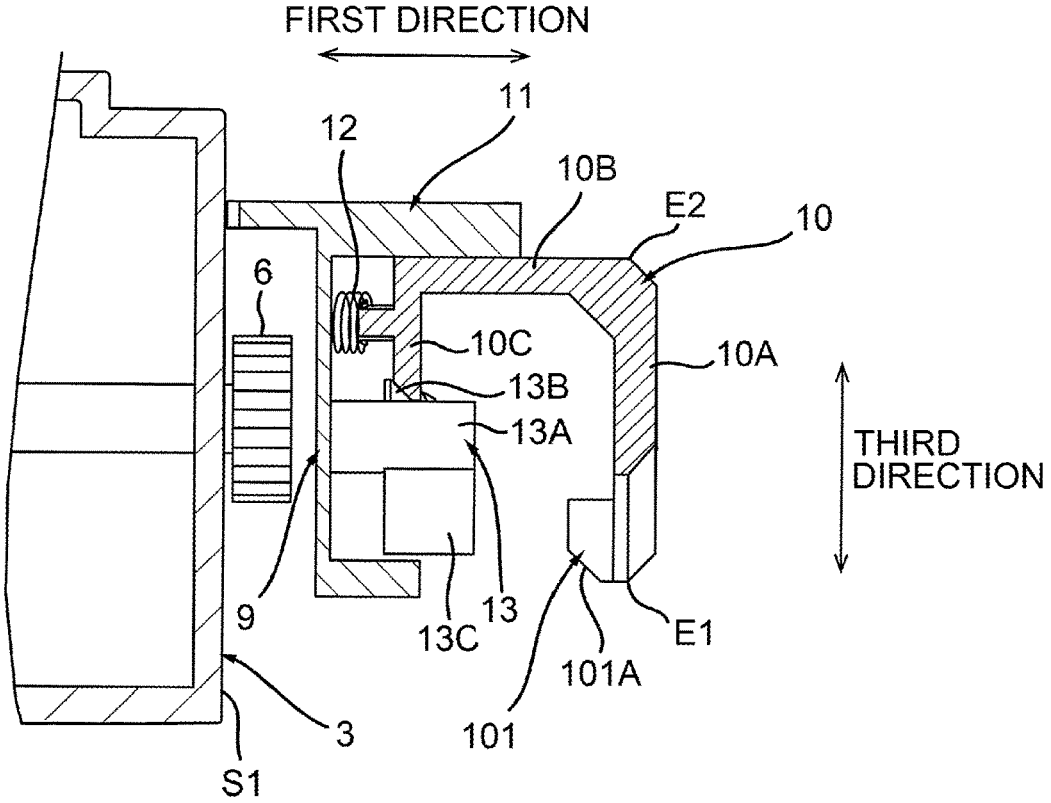
FIG. 4A is a view illustrating movement of a hook and showing a state in which the hook is positioned at a first position.
Figure 4B:
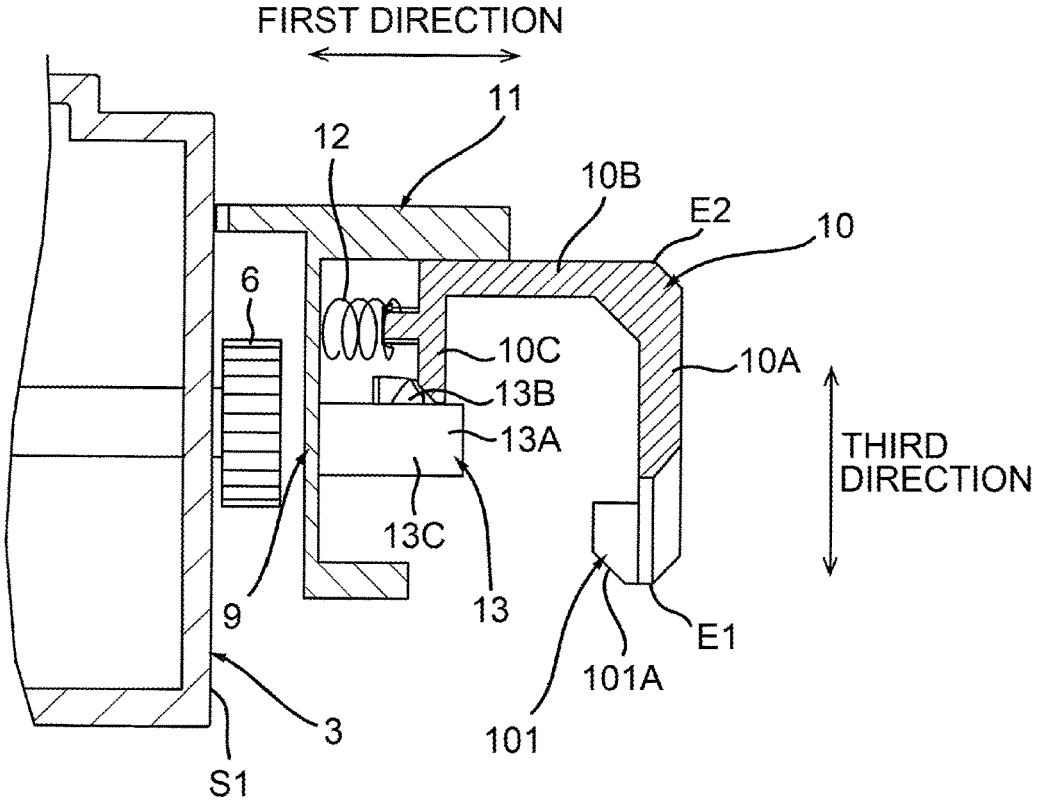
FIG. 4B is a view illustrating movement of the hook and showing a state in which the hook is positioned at a second position.

As shown in FIGS. 4A and 4B, the hook 10 is movable, along the first direction, between a first position (refer to FIG. 4A) and a second position (refer to FIG. 4B). The hook 10, when positioned at the second position, is farther from the housing 3 than when positioned at the first position.

Figure 5A:
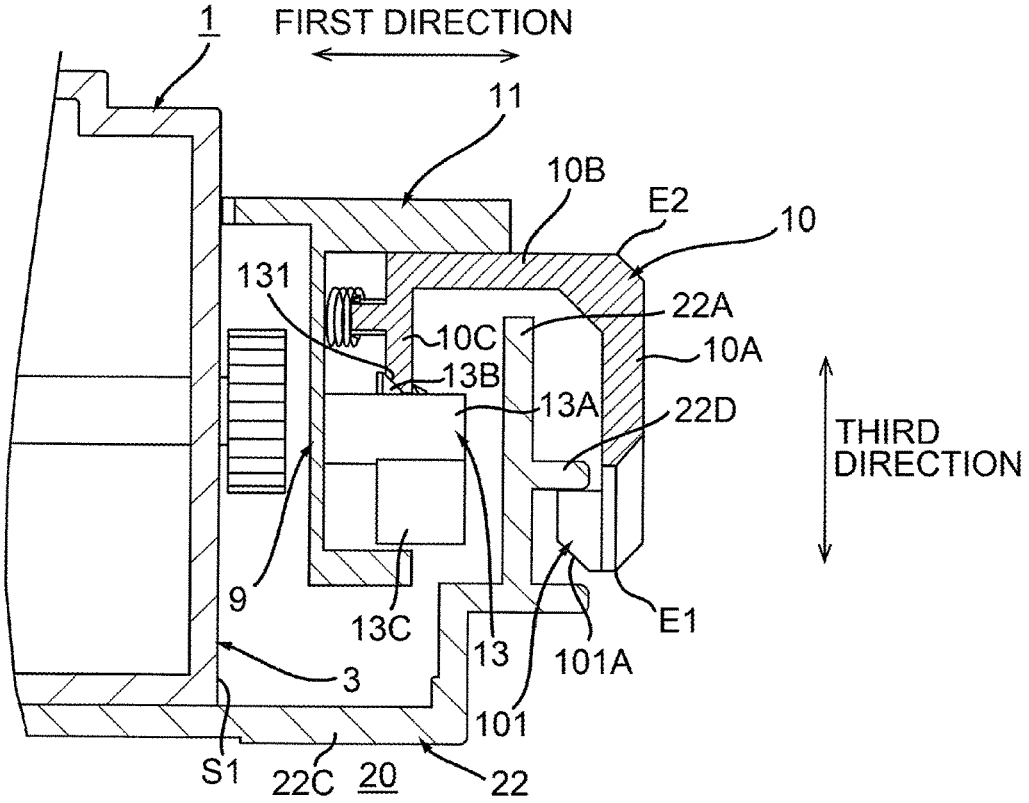
FIG. 5A shows a state in which the hook positioned at the first position is caught by a rib of the drum cartridge on which the developer cartridge is mounted.

As shown in FIG. 5A, when the hook 10 is positioned at the first position in a state in which the developer cartridge 1 is mounted on the drum cartridge 20, the hook 10 hooks a portion of the drum cartridge 20. Specifically, in this case, the hook 10 hooks a rib 22D of a drum frame 22 of the drum cartridge 20. The drum frame 22 will be described later. The developer cartridge 1 is not removable from the drum cartridge 20 due to the hook 10 hooks the rib 22D of the drum cartridge 20.

Figure 5B:
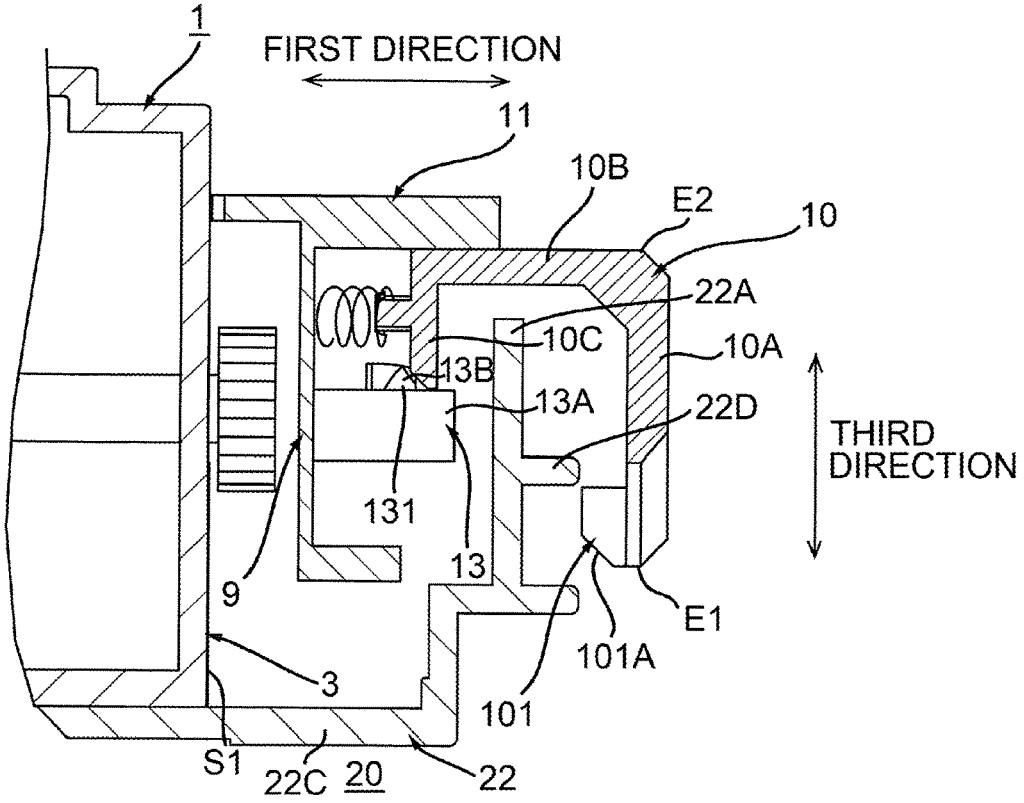
FIG. 5B shows a state in which the hook positioned at the second position is released from the rib of the drum cartridge on which the developer cartridge is mounted.

In contrast, as shown in FIG. 5B, when the hook 10 is positioned at the second position in a state in which the developer cartridge 1 is mounted on the drum cartridge 20, the hook 10 does not hook the drum cartridge 20. The developer cartridge 1 is removable from the drum cartridge 20 because of the hook 10 does not hook the drum cartridge 20.

Specifically, as shown in FIG. 4A, the hook 10 includes a first plate 10A, a second plate 10B, and a third plate 10C.

The first plate 10A is positioned spaced from the housing 3 in the first direction. The first plate 10A extends in a third direction. The third direction crosses both the first direction and the second direction. Specifically, the third direction is orthogonal to the first direction and crosses the second direction. The first plate 10A has a first end E1 and a second end E2 in the third direction. The second end E2 is positioned away from the first end E1. The first plate 10A includes a protrusion 101.

The protrusion 101 is positioned at the first end E1 of the first plate 10A. The protrusion 101 protrudes from the first plate 10A toward the housing 3. The protrusion 101 extends in the first direction. The protrusion 101 has an inclined surface 101A. The inclined surface 101A is inclined relative to the third direction. Specifically, the inclined surface 101A is inclined such that its portion farther from the first end E1 toward the second end E2 is closer to the housing 3.

The second plate 10B is positioned spaced from the protrusion 101 in the third direction. The second plate 10B extends from the second end E2 of the first plate 10A toward the housing 3. The second plate 10B extends in the first direction.

The third plate 10C is positioned spaced from the first plate 10A in the first direction. The third plate 10C is positioned between the housing 3 and the first plate 10A in the first direction. The third plate 10C extends from the second plate 10B. The third plate 10C extends in the third direction.

2.2 Guide 11

The guide 11 guides movement of the hook 10 between the first position (refer to FIG. 4A) and the second position (refer to FIG. 4B). Specifically, the guide 11 faces the second plate 10B of the hook 10 in the third direction. The guide 11 extends in the first direction. In this illustrative embodiment, the guide 11 extends from the gear cover 9. Alternatively, the guide 11 may extend from the housing 3. The guide 11 has a plate shape. When the hook 10 moves between the first position and the second position, the hook 10 moves, along the guide 11 in the first direction, with the second plate 10B in contact with the guide 11.

2.3 Tension Spring 12

The tension spring 12 is positioned between the gear cover 9 and the hook 10 in the first direction. The tension spring 12 is positioned between the housing 3 and the hook 10 in the first direction. The tension spring 12 is extendable and retractable in the first direction. One end of the tension spring 12 in the first direction is coupled to the third plate 10C of the hook 10. In this illustrative embodiment, the other end of the tension spring 12 in the first direction is coupled to the gear cover 9. Alternatively, the other end of the tension spring 12 may be coupled to the housing 3. The tension spring 12 pulls the hook 10 positioned at the second position (refer to FIG. 4B) toward the first position (refer to FIG. 4A).

2.4 Cam 13

As shown in FIG. 4A, in this illustrative embodiment, the cam 13 is attached to the gear cover 9. The cam 13 is positioned at the outer surface S1 of the housing 3 via the gear cover 9. Alternatively, the cam 13 may be attached to the housing 3. The cam 13 is positioned opposite to the guide 11 relative to the third plate 10C in the third direction.

Figure 6A:
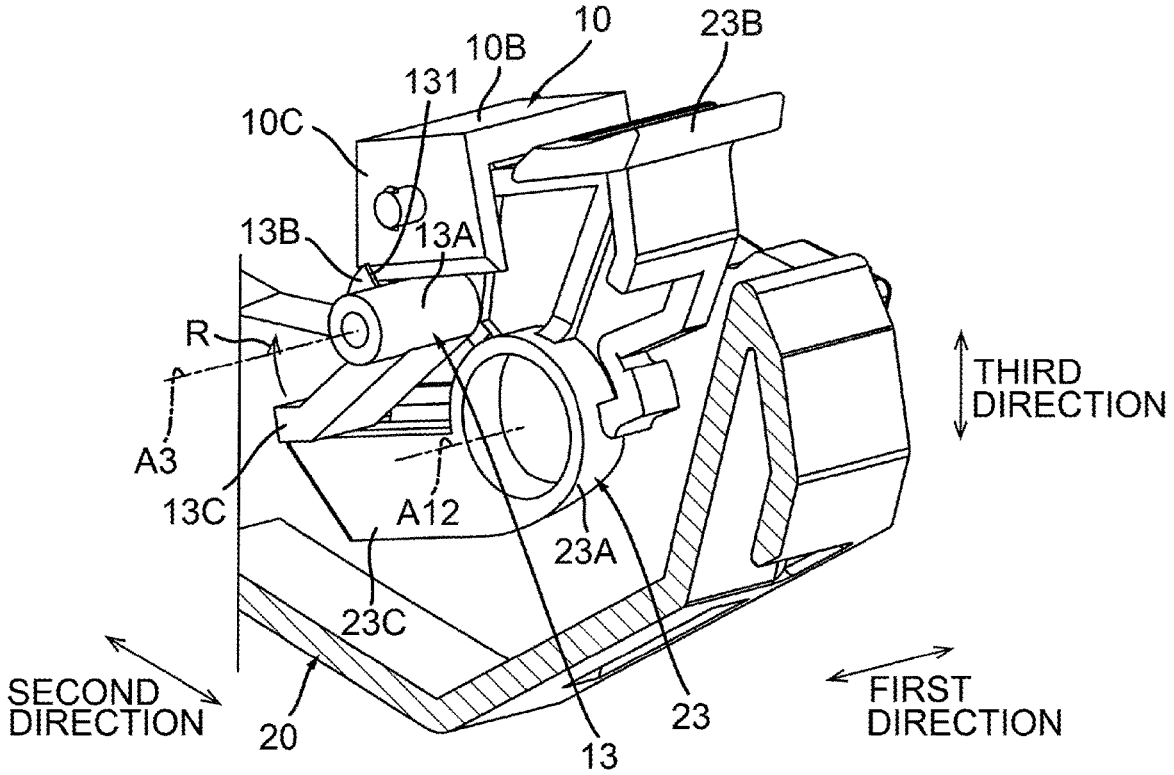
FIG. 6A is a view illustrating interaction between a lever and the hook and showing a state in which the lever is positioned at a lever first position, a cam at a first pivot position, and the hook at the first position.
Figure 6B:
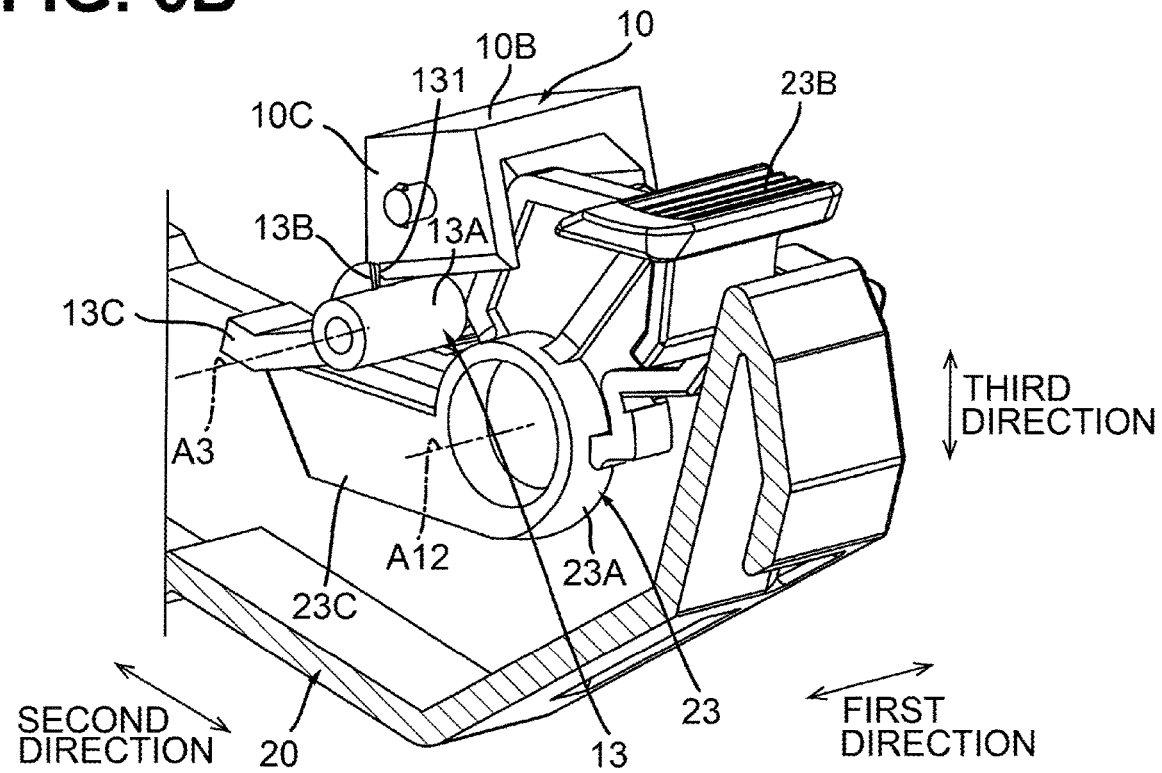
FIG. 6B is a view illustrating interaction between the lever and the hook and showing a state in which the lever is positioned at a lever second position, the cam at a second pivot position, and the hook at the second position.

As shown in FIGS. 6A and 6B, the cam 13 is movable between a first pivot position (refer to FIG. 6A) and a second pivot position (refer to FIG. 6B). The cam 13 is pivotable between the first pivot position and the second pivot position about a pivot axis A3 extending in the first direction.

Specifically, as shown in FIG. 2, the cam 13 includes a shaft 13A, a protrusion 13B, and a lever 13C.

2.4.1. Shaft 13A

The shaft 13A extends along the pivot axis A3 (refer to FIG. 6A) in the first direction. The shaft 13A is cylindrical. The shaft 13A is positioned opposite to the guide 11 (refer to FIG. 4A) relative to the third plate 10C in the third direction.

2.4.2 Protrusion 13B

The protrusion 13B is positioned at a circumferential surface of the shaft 13A. The protrusion 13B protrudes from the circumferential surface of the shaft 13A. The protrusion 13B extends in a pivot direction R in which the cam 13 pivots from the first pivot position to the second pivot position. Alternatively, the protrusion 13B may be attached to the circumferential surface of the shaft 13A. The protrusion 13B has an end E11 and an end E12 in the pivot direction R. The protrusion 13B has an inclined surface 131 and a flat surface 132.

The inclined surface 131 is positioned at the end E12 of the protrusion 13B. The inclined surface 131 is inclined relative to the pivot direction R. The inclined surface 131 is inclined such that its portion more downstream in the pivot direction R is closer to the housing 3.

The flat surface 132 is positioned upstream of the inclined surface 131 in the pivot direction R. The flat surface 132 extends along the pivot direction R.

As shown in FIG. 5A, when the cam 13 is positioned at the first pivot position (refer to FIG. 6A), the inclined surface 131 of the protrusion 13B faces, in the first direction, the third plate 10C of the hook 10 positioned at the first position. When the cam 13 is positioned at the first pivot position, the protrusion 13B does not push the hook 10 positioned at the first position. When the cam 13 is positioned at the first pivot position, the protrusion 13B may be spaced from the third plate 10C. When the cam 13 is positioned at the first pivot position, the protrusion 13B may be in contact with the third plate 10C. Since the protrusion 13B does not push the hook 10, the hook 10 is positioned at the first position due to a force of the tension spring 12. In other words, the cam 13, when positioned at the first pivot position, permits the hook 10 to be positioned at the first position.

As shown in FIGS. 5A and 5B, when the cam 13 pivots from the first pivot position to the second pivot position (refer to FIG. 6B), the inclined surface 131 of the protrusion 13B contacts the third plate 10C of the hook 10 positioned at the first position. As the cam 13 pivots from the first pivot position to the second pivot position, the hook 10 positioned at the first position is pushed by the inclined surface 131 toward the second position. Then, the hook 10 moves from the first position toward the second position.

When the cam 13 is positioned at the second pivot position, the flat surface 132 of the protrusion 13B contacts the third plate 10C of the hook 10. Upon contact of the flat surface 132 of the protrusion 13B with the third plate 10C, the hook 10 is positioned at the second position. In short, the cam 13, when positioned at the second pivot position, positions the hook 10 at the second position.

2.4.3 Lever 13C

As shown in FIG. 6A, the lever 13C extends from the circumferential surface of the shaft 13A. The lever 13C extends in a radial direction of the shaft 13A. In a state in which the cam 13 is positioned at the first pivot position (refer to FIG. 6A), the lever 13C is positioned opposite to the third plate 10C of the hook 10 relative to the shaft 13A in the third direction. When the lever 13C is pushed toward the pivot direction R in a state in which the cam 13 is positioned at the first pivot position, the cam 13 pivots from the first pivot position to the second pivot position (refer to FIG. 6B).

3. Drum Cartridge 20

Referring now to the FIGS. 3 and 5A through 6B, the drum cartridge 20 to which the developer cartridge 1 is mounted will be described.

As shown in FIG. 3, the drum cartridge 20 includes a photosensitive drum 21, the drum frame 22, and a lever 23.

3.1. Photosensitive Drum 21

The photosensitive drum 21 is rotatable about an axis A11 extending in the first direction. The photosensitive drum 21 extends along the axis A11 in the first direction. The photosensitive drum 21 is cylindrical. The photosensitive drum 21 is positioned at one end portion of the drum cartridge 20 in the second direction.

3.2 Drum Frame 22

The drum frame 22 supports the photosensitive drum 21. In a state in which the developer cartridge 1 is mounted on the drum cartridge 20, the drum frame 22 supports the developer cartridge 1. The drum frame 22 extends in the first direction and the second direction. The drum frame 22 has a tray shape. The drum frame 22 includes a first side plate 22A, a second side plate 22B, a bottom plate 22C (refer to FIG. 5A), and the rib 22D (refer to FIG. 5A).

The first side plate 22A is positioned at one end of the drum frame 22 in the first direction. As shown in FIG. 5A, the first side plate 22A extends in the third direction. In a state in which the developer cartridge 1 is mounted on the drum cartridge 20, the first side plate 22A faces the outer surface S1 of the housing 3 in the first direction. In the state in which the developer cartridge 1 is mounted on the drum cartridge 20, the first side plate 22A is positioned, in the first direction, between the outer surface S1 of the housing 3 and the first plate 10A of the hook 10. In the state in which the developer cartridge 1 is mounted on the drum cartridge 20, the first side plate 22A is spaced from the outer surface S1 of the housing 3 in the first direction. In the state in which the developer cartridge 1 is mounted on the drum cartridge 20, the cam 13 is positioned between the outer surface S1 of the housing 3 and the first side plate 22A in the first direction.

As shown in FIG. 3, the second side plate 22B is positioned at the other end of the drum frame 22 in the first direction. The second side plate 22B extends in the third direction. In a state in which the developer cartridge 1 is mounted on the drum cartridge 20, the second side plate 22B is positioned opposite to the first side plate 22A relative to the housing 3 in the first direction.

As shown in FIG. 5A, the bottom plate 22C is positioned between the first side plate 22A and the second side plate 22B (refer to FIG. 3) in the first direction. The bottom plate 22C extends in the first direction. One end of the bottom plate 22C in the first direction is connected to the first side plate 22A. The other end of the bottom plate 22C in the first direction is connected to the second side plate 22B.

The rib 22D protrudes from the first side plate 22A in the first direction. The rib 22D may be attached to the first side plate 22A. The rib 22D is positioned opposite to the second side plate 22B relative to the first side plate 22A in the first direction. When the hook 10 is positioned at the first position in a state in which the developer cartridge 1 is mounted on the drum cartridge 20, the hook 10 is caught by the rib 22D. The rib 22D is an example of a portion of the drum cartridge 20. A portion of the drum cartridge 20 for catching the hook 10 is not limited to the rib 22D. A portion of the drum cartridge 20 for catching the hook 10 may be a recess.

3.3 Lever 23

As shown in FIG. 3, the lever 23 is positioned spaced from the photosensitive drum 21 in the second direction. The lever 23 is positioned at the other end portion of the drum cartridge 20 in the second direction. In a state in which the developer cartridge 1 is mounted on the drum cartridge 20, the lever 23 is positioned opposite to the photosensitive drum 21 relative to the electrode 5 in the second direction. The lever 23 is attached to the drum frame 22. Specifically, the lever 23 is attached to the first side plate 22A of the drum frame 22. The lever 23 is used to remove from the drum cartridge 20 the developer cartridge 1 mounted on the drum cartridge 20.

Specifically, as shown in FIGS. 6A and 6B, the lever 23 is movable between a lever first position (refer to FIG. 6A) and a lever second position (refer to FIG. 6B). The lever 23 is pivotable between the lever first position and the lever second position about a pivot axis A12 extending in the first direction.

Specifically, as shown in FIG. 6A, the lever 23 includes a cylindrical portion 23A, an operative portion 23B, and a push portion 23C.

The cylindrical portion 23A extends along the pivot axis A12 in the first direction.

The operative portion 23B is operated by a user to move the lever 23 from the lever first position to the lever second position. By pressing the operative portion 23B, a user is allowed to move the lever 23 from the lever first position to the lever second position. The operative portion 23B extends from the cylindrical portion 23A. The operative portion 23B extends in a radial direction of the cylindrical portion 23A. In a state in which the lever 23 is positioned at the lever first position, the operative portion 23B extends in the third direction. In a state in which the developer cartridge 1 is mounted on the drum cartridge 20 and the lever 23 is positioned at the lever first position, the operative portion 23B is positioned opposite to the photosensitive drum 21 (refer to FIG. 3) relative to the hook 10 in the second direction.

The push portion 23C extends from the cylindrical portion 23A. The push portion 23C extends in a radial direction of the cylindrical portion 23A. In a state in which the lever 23 is positioned at the lever first position, the push portion 23C extends toward the lever 13C of the cam 13. When the lever 23 moves from the lever first position to the lever second position in a state in which the drum cartridge 1 is mounted on the developer cartridge 20, the push portion 23C pushes the lever 13C of the cam 13 toward the pivot direction R.

4. Removal of Developer Cartridge 1 from Drum Cartridge 20

Referring now to the FIGS. 5A and 6B, removal of the developer cartridge 1 from the drum cartridge 20 will be described.

To remove from the drum cartridge 20 the developer cartridge 1 mounted on the drum cartridge 20, a user presses the operative portion 23B of the lever 23.

Then, as shown in FIGS. 6A and 6B, the lever 23 moves from the lever first position to the lever second position, and the push portion 23C of the lever 23 pushes the lever 13C of the cam 13 toward the pivot direction R. The cam 13 pivots from the first pivot position to the second pivot position. In short, when the lever 23 is operated in a state in which the developer cartridge 1 is mounted on the drum cartridge 20, the cam 13 moves from the first pivot position to the second pivot position.

When the cam 13 moves from the first pivot position to the second pivot position, the protrusion 13B of the cam 13 pushes the third plate 10C of the hook 10. Then, as shown in FIGS. 5A and 5B, the hook 10 moves from the first position (refer to FIG. 5A) to the second position (refer to FIG. 5B). In short, when the cam 13 moves from the first pivot position to the second pivot position, the hook 10 moves from the first position to the second position.

As shown in FIG. 5B, the hook 10, when positioned at the second position, is released from the rib 22D. The hook 10 released from the rib 22D allows the developer cartridge 1 to be removed from the drum cartridge 20. In short, in a state in which the hook 10 is positioned at the second position, the developer cartridge 1 is removable from the drum cartridge 20.

By removing, by a user, the developer cartridge 1 from the drum cartridge 20 while positioning the lever 23 at the lever second position, the developer cartridge 1 is removed from the drum cartridge 20.

Alternatively, a user may remove the developer cartridge 1 from the drum cartridge 20 by holding and moving the hook 10 from the first position to the second position without operating the lever 23. In short, the hook 10 may be operated, in a state in which the developer cartridge 1 is mounted on the drum cartridge 20, to move from the first position to the second position.

5. Mounting of Developer Cartridge 1 to Drum Cartridge 20

Figure 7A:
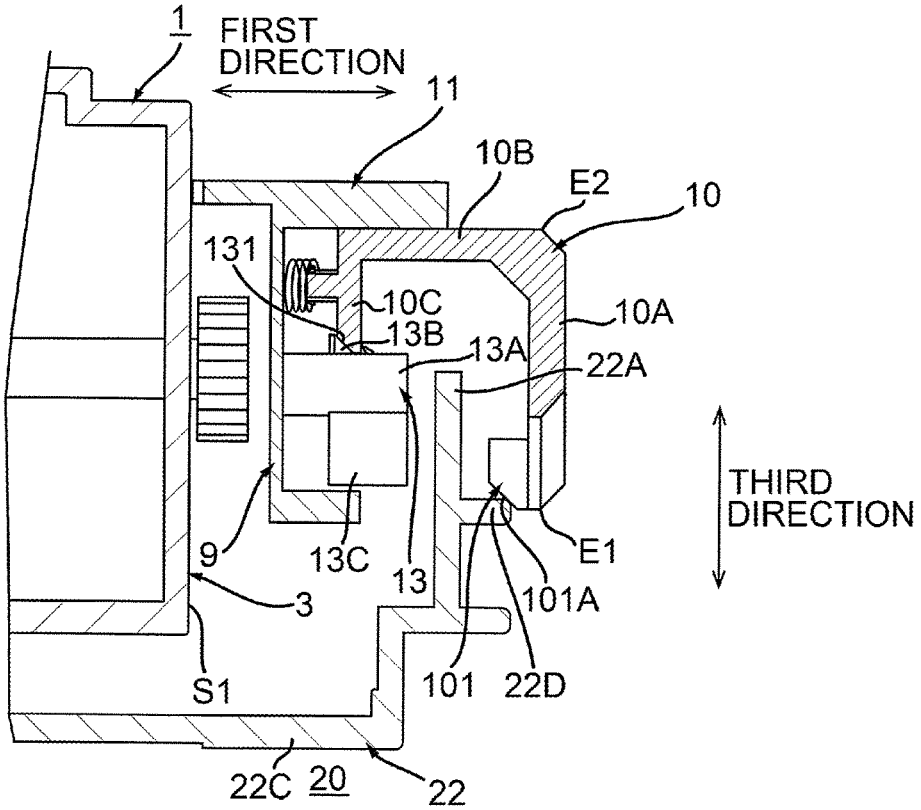
FIG. 7A is a view illustrating mounting of the developer cartridge to the drum cartridge and showing a state in which the hook at the first position is positioned at the rib of the drum cartridge.
Figure 7B:
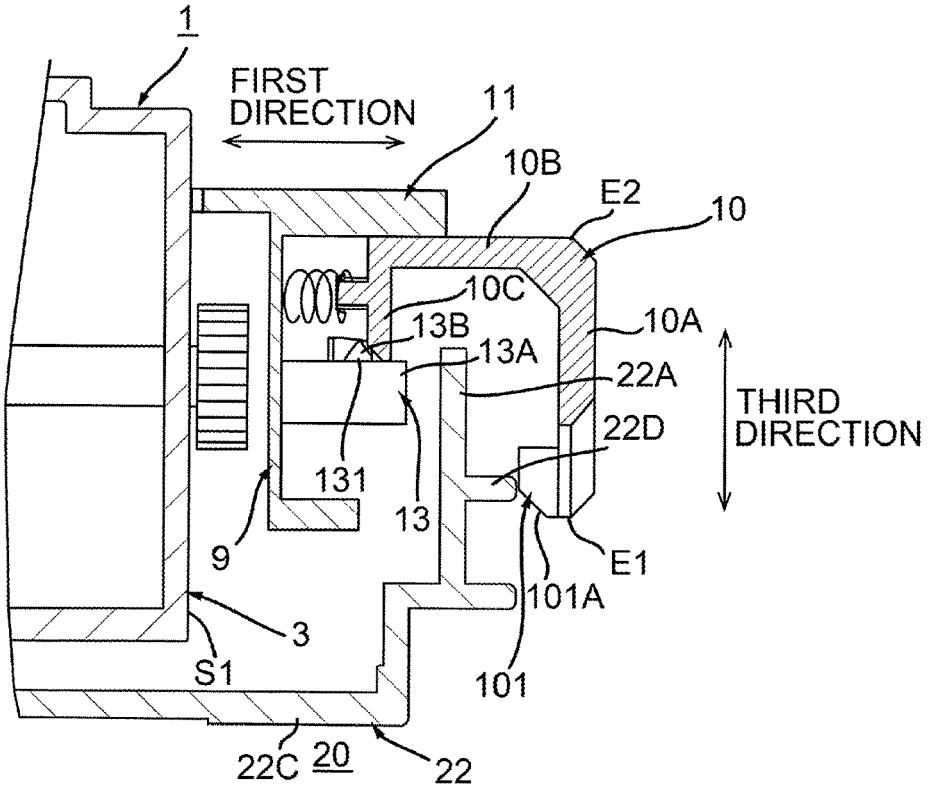
FIG. 7B is a view illustrating mounting of the developer cartridge to the drum cartridge and showing a state in which the hook is moved from the first position to the second position by the rib of the drum cartridge.

Referring now to FIGS. 5A, 7A, and 7B, mounting of the developer cartridge 1 to the drum cartridge 20 will be described.

As shown in FIG. 7A, in the middle of mounting the developer cartridge 1 to the drum cartridge 20, the hook 10 contacts the drum cartridge 20. Specifically, in the middle of mounting the developer cartridge 1 to the drum cartridge 20, the inclined surface 131 of the hook 10 contacts the rib 22D of the drum cartridge 20.

As shown in FIGS. 7A and 7B, as the developer cartridge 1 is mounted to the drum cartridge 20, the hook 10 moves, against a force of the tension spring 12, from the first position to the second position due to a reaction force from the drum cartridge 20.

As shown in FIGS. 7B and 5A, at the end of mounting the developer cartridge 1 to the drum cartridge 20, the hook 10 is pulled by the tension spring 12 to move from the second position to the first position.

As shown in FIG. 5A, upon completion of mounting the developer cartridge 1 to the drum cartridge 20, the hook 10 is positioned at the first position and caught by the rib 22D. Accordingly, the developer cartridge 1 becomes unremovable from the drum cartridge 20.

6. Effects

As shown in FIG. 1, the developer cartridge 1 includes the hook 10 movable, on an opposite side of the gear 7 (refer to FIG. 2) from the developing roller 2, between the first position (refer to FIG. 1) and the second position (refer to FIG. 4B).

As shown in FIG. 5A, when the developer cartridge 1 is mounted to the drum cartridge 20, the hook 10 is caught by a portion of the drum cartridge 20, specifically by the rib 22D, thereby locking the developer cartridge 1 to the drum cartridge 20.

Consequently, even when there is a difficulty to provide a lock unit to the drum cartridge 20, the hook 10 provided to the developer cartridge 1 locks the developer cartridge 1 to the drum cartridge 20.

In order to remove the developer cartridge 1 from the drum cartridge 20, the hook 10 is moved as shown in FIG. 5B to be released from the portion of the drum cartridge 20, thereby unlocking the developer cartridge 1 from the drum cartridge 20.

In addition, as shown in FIGS. 7A and 7B, mounting the developer cartridge 1 to the drum cartridge 20 causes the hook 10 to move from the first position to the second position and then, as shown in FIGS. 7B and 5A, completion of mounting the developer cartridge 1 to the drum cartridge 20 causes the hook 10 to move from the second position to the first position due to a force of the tension spring 12.

This may improve operability without the need for separate operations for mounting the developer cartridge 1 to the drum cartridge 20 and for moving the hook 10.

7. Modification

Figure 8:
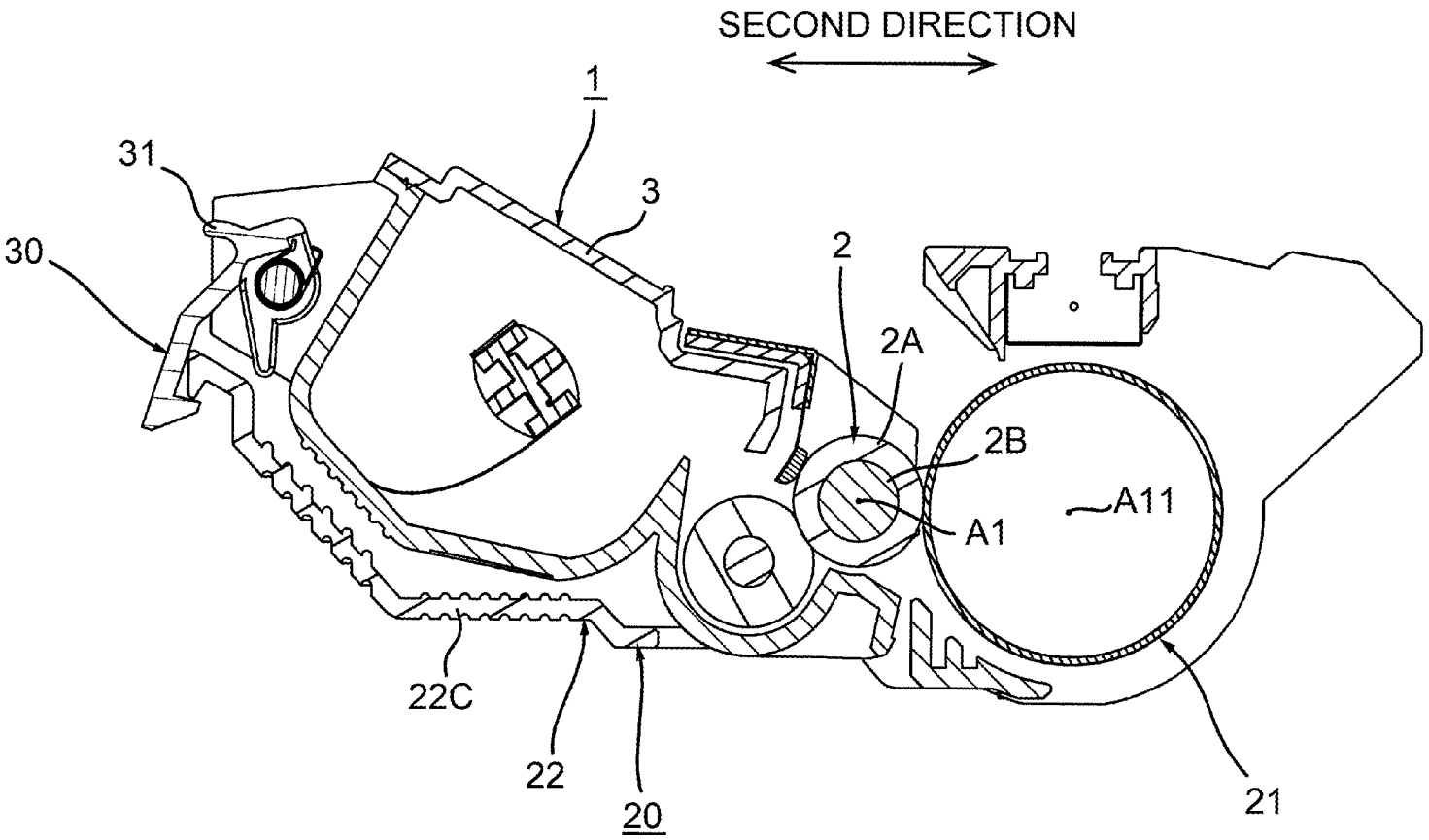
FIG. 8 is a view illustrating a modification in which a hook is positioned at a first position.
Figure 9:
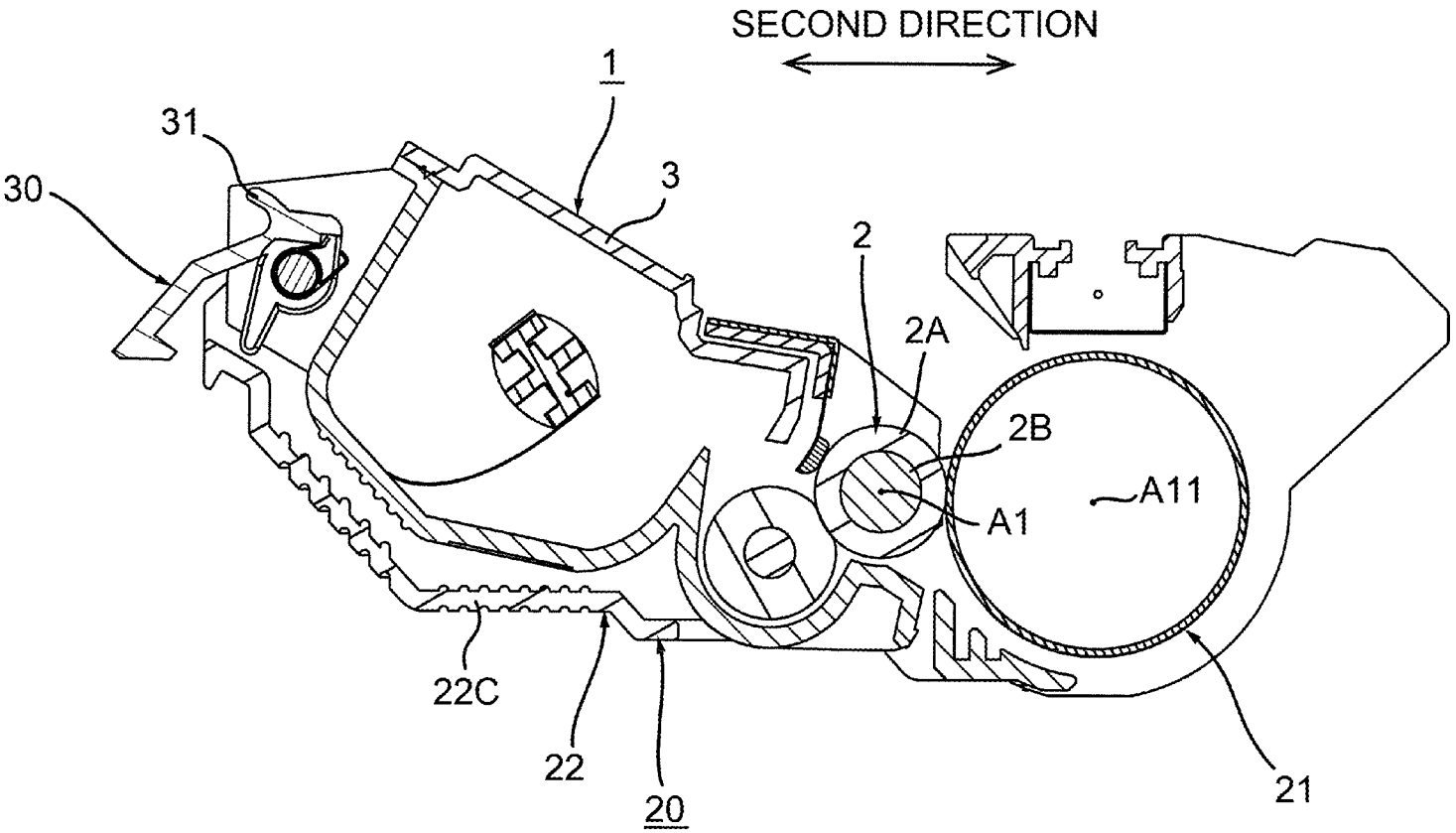
FIG. 9 is a view illustrating the modification in which the hook is positioned at a second position.

Referring now to FIGS. 8 and 9, a modification to the above-described embodiment will be described. In the modification, similar elements to those described in the above embodiment will be indicated by like reference characters and omitted from description.

As shown in FIG. 8, a hook 30 may be positioned at an outer surface of the housing 3 in the second direction. In other words, the hook 30 may not be positioned at the outer surface S1 of the housing 3 in the first direction. The hook 30 is positioned opposite to the developing roller 2 relative to the housing 3 in the second direction.

As shown in FIGS. 8 and 9, the hook 30 may be pivotable between a first position (refer to FIG. 8) and a second position (refer to FIG. 9). In other words, the hook 30 may not move in the first direction.

The hook 30 may include a tab 31 to be held by a user. The hook 30 may be positioned to the second position by a user who holds and pivots the hook 30 from the first position to the second position. In short, the hook 30 may be operated, in a state in which the developer cartridge 1 is mounted on the drum cartridge 20, to move from the first position to the second position. In this case, the developer cartridge 1 may not include a cam 13. The drum cartridge 20 may not include a lever 23, either.

What is claimed is:

1. A developer cartridge comprising:

a developing roller rotatable about an axis extending in a first direction;

a housing extending in the first direction and configured to store toner therein;

an electrode positioned at an outer surface of the housing in the first direction and extending in the first direction;

a gear rotatable about the electrode; and a hook positioned opposite to the developing roller relative to the gear in a second direction and movable between a first position and a second position.

2. The developer cartridge according to claim 1, wherein the hook is movable along the first direction between the first position and the second position at which the hook is farther from the housing than when at the first position.

3. The developer cartridge according to claim 2, further comprising a cam movable between a first pivot position allowing the hook to be positioned at the first position, and a second pivot position to position the hook at the second position.

4. The developer cartridge according to claim 3, wherein the cam is pivotable about a pivot axis extending in the first direction.

5. The developer cartridge according to claim 2, further comprising a guide extending along the first direction and configured to guide movement of the hook between the first position and the second position.

6. The developer cartridge according to claim 1, wherein the developer cartridge is mountable to a drum cartridge, and wherein the hook is configured to:

when the hook is positioned at the first position in a state in which the developer cartridge is mounted on the drum cartridge, hook a portion of the drum cartridge; and when the hook is positioned at the second position in a state in which the developer cartridge is mounted on the drum cartridge, not hook the drum cartridge.

7. The developer cartridge according to claim 6, further comprising a tension spring configured to pull the hook positioned at the second position toward the first position, wherein the hook is configured to:

in the middle of mounting the developer cartridge to the drum cartridge, contact the drum cartridge and move, against a force of the tension spring, from the first position to the second position due to a reaction force from the drum cartridge; and at the end of mounting the developer cartridge to the drum cartridge, move from the second position to the first position by being pulled by the tension spring.

8. The developer cartridge according to claim 6, wherein the drum cartridge includes a lever configured to remove the developer cartridge mounted on the drum cartridge from the drum cartridge, wherein the developer cartridge includes a cam movable between a first pivot position allowing the hook to be positioned at the first position, and a second pivot position to position the hook at the second position, wherein when the lever is operated in a state in which the developer cartridge is mounted on the drum cartridge, the cam moves from the first pivot position to the second pivot position to cause the hook to move from the first position to the second position, and wherein the developer cartridge is removable from the drum cartridge in a state in which the hook is positioned at the second position.

9. The developer cartridge according to claim 6, wherein the hook is operated to move from the first position to the second position in a state in which the developer cartridge is mounted on the drum cartridge, and wherein the developer cartridge is removable from the drum cartridge in a state in which the hook is positioned at the second position.

10. The developer cartridge according to claim 1, further comprising a protrusion rotatable with the gear.

11. The developer cartridge according to claim 1, wherein the gear is a chipped teeth gear including a portion with gear teeth and a portion without gear teeth.

* * * * *